US006099316A

United States Patent [19]

Levy et al.

[11] Patent Number: 6,099,316

[45] Date of Patent: Aug. 8, 2000

[54] SIMULATED ASSAULT WEAPON

[75] Inventors: Alan M. Levy; James R. Schmidt; Michael R. Hinchliffe; Garland L. Markley; Philip K. Richardson; Paul B. Davis; George Konovalov, all of Los Angeles, Calif.

[73] Assignee: Universal Studios, Inc., Universal City, Calif.

[21] Appl. No.: 09/069,479

[22] Filed: Apr. 29, 1998

[51] Int. Cl.[7] ..... A63J 5/02

[52] U.S. Cl. ..... 434/16; 434/21; 42/55; 102/355

[58] Field of Search ..... 102/355; 434/16, 434/20, 21; 42/55

[56] References Cited

U.S. PATENT DOCUMENTS

| | | | |
|---|---|---|---|
| 2,097,749 | 11/1937 | Wade . | |
| 2,157,181 | 5/1939 | Lohr . | |
| 2,588,036 | 3/1952 | O'Quinn . | |
| 2,734,311 | 2/1956 | Christopher . | |
| 3,240,924 | 3/1966 | Darby . | |
| 3,272,510 | 9/1966 | Ohlund et al. . | |
| 3,423,848 | 1/1969 | Ohlund . | |
| 3,938,262 | 2/1976 | Dye et al. | 434/21 |
| 4,416,630 | 11/1983 | Hagen et al. | 434/16 |
| 4,654,008 | 3/1987 | Elmore | 434/16 |
| 4,802,675 | 2/1989 | Wong et al. | 273/310 |
| 5,233,776 | 8/1993 | Hessey | 434/16 |
| 5,396,844 | 3/1995 | Hessey | 102/355 |
| 5,518,401 | 5/1996 | FitzGerald et al. | 434/16 |

FOREIGN PATENT DOCUMENTS

| | | | |
|---|---|---|---|
| 246991 | 11/1987 | European Pat. Off. | 434/21 |
| 1184355 | 3/1970 | United Kingdom | 434/21 |

OTHER PUBLICATIONS

Information Sheet Re Project 640 Gas Gun, D.K. Dreager Design Studio Inc. dated Sep., 1995—7 sheets.

*Primary Examiner*—Stephen M. Johnson
*Attorney, Agent, or Firm*—Lyon & Lyon LLP

[57] ABSTRACT

A simulated weapon creates a muzzle flash and smoke effect. The simulated weapon has an elongated tube portion having a closed end and an open end. A high-intensity light source enters the elongated tube near the closed end. A communication passageway in the elongated tube conducts a pulse of theatrical haze through the weapon. A target illuminator is mounted on the elongated tube. A pressurized pulse of theatrical haze is delivered through a barrel of the weapon. The high-intensity light source is flashed as the pressurized pulse of theatrical haze exits the barrel.

18 Claims, 2 Drawing Sheets

SIMULATED ASSAULT WEAPON

BACKGROUND OF THE INVENTION

FIELD OF THE INVENTION

The field of the invention is simulated weapons.

Simulated weapons are used in many situations. One common use of such weapons is in the performance of theatrical productions or in motion pictures. Simulated weapons have also been used in amusement/theme park attractions and rides. Weapons that simulate the firing of projectiles, missiles, and the like are especially useful.

A simulated weapon should provide the same sounds and visual appearance as a real weapon. If the simulated weapon fires missiles or projectiles, it is particularly desirable to mimic the muzzle flashes that accompany the firing of the weapon. The sounds of each round of firing should also be provided, for a more realistic simulation.

Various attempts have been made to reproduce these weapon effects. For example, attempts have been made using weapons using combustible materials, such as natural gas, to simulate the effect of muzzle flashes. However, devices using combustible fuels to reproduce muzzle flashes are potentially hazardous when the weapon is close to the audience. Burning combustibles indoors also increases the ventilation and air conditioning requirements. In addition, simulated weapons which use combustibles are often mechanically complex devices, thereby increasing costs and decreasing reliability.

Some devices have attempted to simulate smoke from a weapon using fine powders and the like. However, from a health standpoint, fine particulate matter is not favored, since the fine powders may adversely affect the breathing and comfort of the audience. Once released, fine powders can also be difficult to contain and control. Accordingly, improved simulated weapons are needed.

SUMMARY OF THE INVENTION

To these ends, in a first aspect of the present invention, a simulated weapon preferably includes an elongated tube having a closed end and an open end. A high-intensity light source is advantageously directed into the elongated tube near the closed end. In the preferred design, a communication passageway in the elongated tube permits a pulse of theatrical haze to travel in and through the elongated tube and out the open end. The simulated weapon may also include a target illuminator mounted on the elongated tube for illuminating a target. In a second separate aspect of the present invention, a method of simulating a muzzle flash in a weapon is provided. The method advantageously includes the steps of generating a quantity of theatrical haze, delivering a pressurized pulse of theatrical haze through a barrel of the weapon, and modulating a light source located in the barrel of the weapon when the pressurized pulse of theatrical haze exits the barrel of the weapon.

Accordingly, it is an object of the present invention to provide an improved simulated weapon and method that accurately reproduces the muzzle flash of firing weapons. Other and further objects and advantages will appear hereinafter.

DETAILED DESCRIPTION OF THE PREFERRED EMBODIMENT

Figure 1:
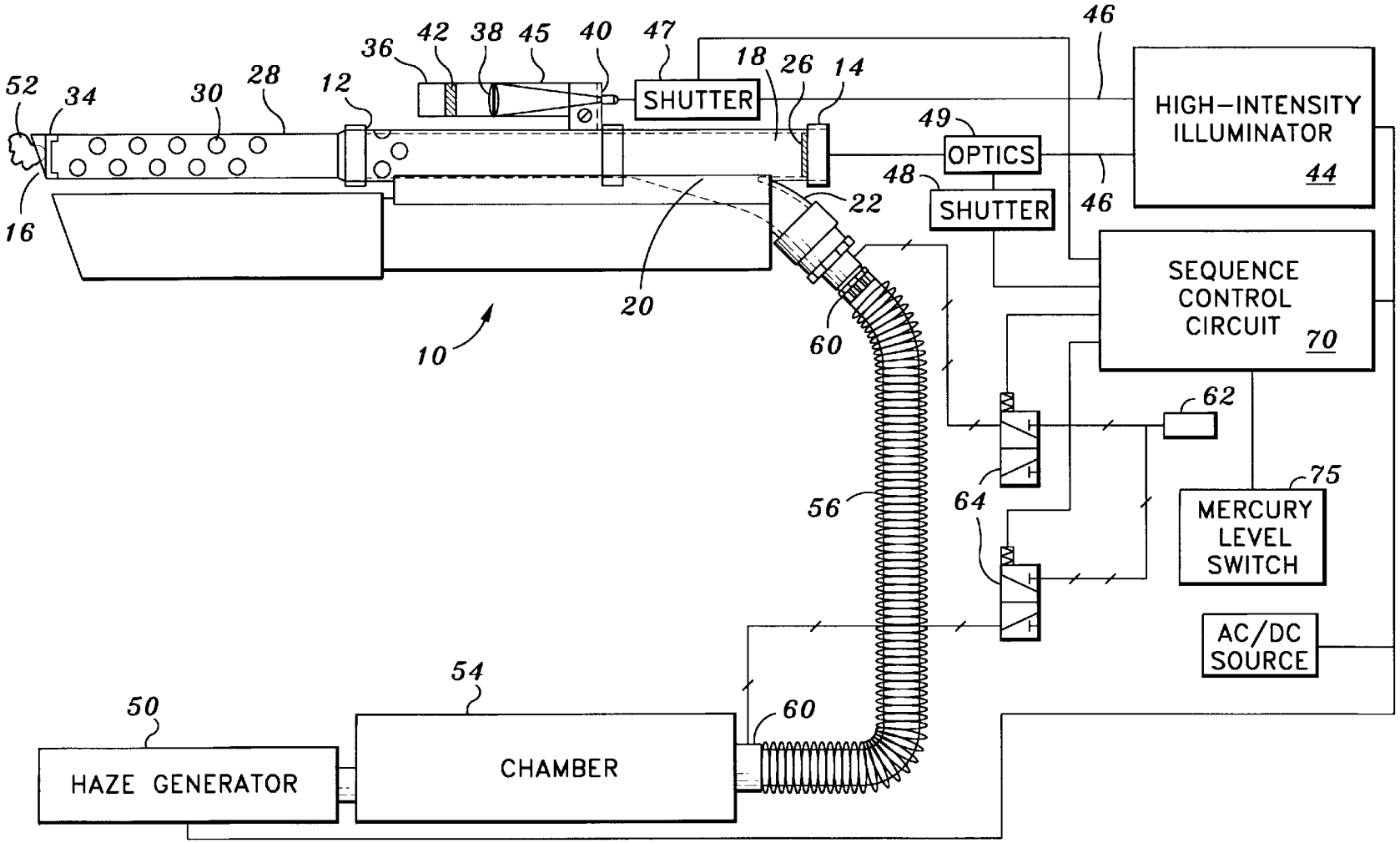
FIG. 1 is a schematic view of the present simulated weapon.

Turning now in detail to FIG. 1, a simulated weapon 10 includes an elongated tube section 12. The elongated tube 12 has a closed end 14 and an open end 16. The elongated tube 12 has hollow barrel portion 18 throughout the length of the elongated tube 12. Preferably, the elongated tube 12 is made of clear plastic and masked with black paint or other opaque material around its outer surface. On the exterior of the elongated tube 12 is a communication passageway 20 that passes through the exterior of the elongated tube 12 and into the hollow barrel 18 of the simulated weapon 10. Preferably, a hollow y-fitting 22 is fixed to the communication passageway 20 to permit communication with the hollow barrel 18 of the elongated tube 12.

A high-intensity light source 44 or illuminator is optically connected via fiber optic cable 46 to the closed end 14 of the elongated tube 12 within the hollow barrel 18. While the preferred embodiment uses a high-intensity light source 44 that is connected to the closed end 14 of the elongated tube 12 to provide the muzzle flash effect, a strobe light or the like positioned within the hollow barrel near the closed end 14 could also be used. A shutter 48 is located between the high-intensity light source 44 and the tube 12. The shutter either permits or prevents light from travelling through fiber-optic cable 46 as required by the show. An obstruction-free path is provided within the hollow barrel 18 of the elongated tube 12. Light can thus freely travel from the high-intensity light source 44 through the hollow barrel 18, and out the open end 16 of the elongated tube 12. A lens filter 26 is located adjacent to where the high-intensity light source 44 enters the tube 12, between the open end 16 of the elongated tube 12 and the high-intensity light source 44. The lens filter 26 can be of any type that accurately portrays a muzzle flash when the high-intensity light source 44 is modulated. Preferably, the filter lens 26 is a dichroic lens filter. A dichroic lens filter 26 gives the light a reddish hue that accurately simulates a muzzle flash, i.e., a blast of flames and/or sparks resulting from firing the simulated weapon 10. The high-intensity light source 44 is timed to modulate (i.e. flash) when concentrated pulses of theatrical haze 52 exit the elongated tube 12 of the simulated assault weapon 10. An intervening set of optics 49 between the high-intensity illuminator 44 and the tube 12 allows adjustments to be made to the muzzle flash.

A simulated heat shield 28 is located at the end of the elongated tube 12 near the open end 16. The heat shield 28 has a plurality of vent holes 30 that circumferentially surround the elongated tube 12. The heat shield 28 is preferably black or a dark color. A baffle 34 partially blocks off the open end 16. While FIG. 1 illustrates one version of a simulated weapon 10, it would be readily apparent to one skilled in the art that the basic design could be used to simulate a wide-variety of real world weapons. For example, the elongated tube 12 and the heat shield 28 could be replaced with a cluster of tubes to simulate the appearance of a Gattling Gun. The same basic design can also be used to represent a cannon, rocket launcher, rifle, and the like.

Figure 2:
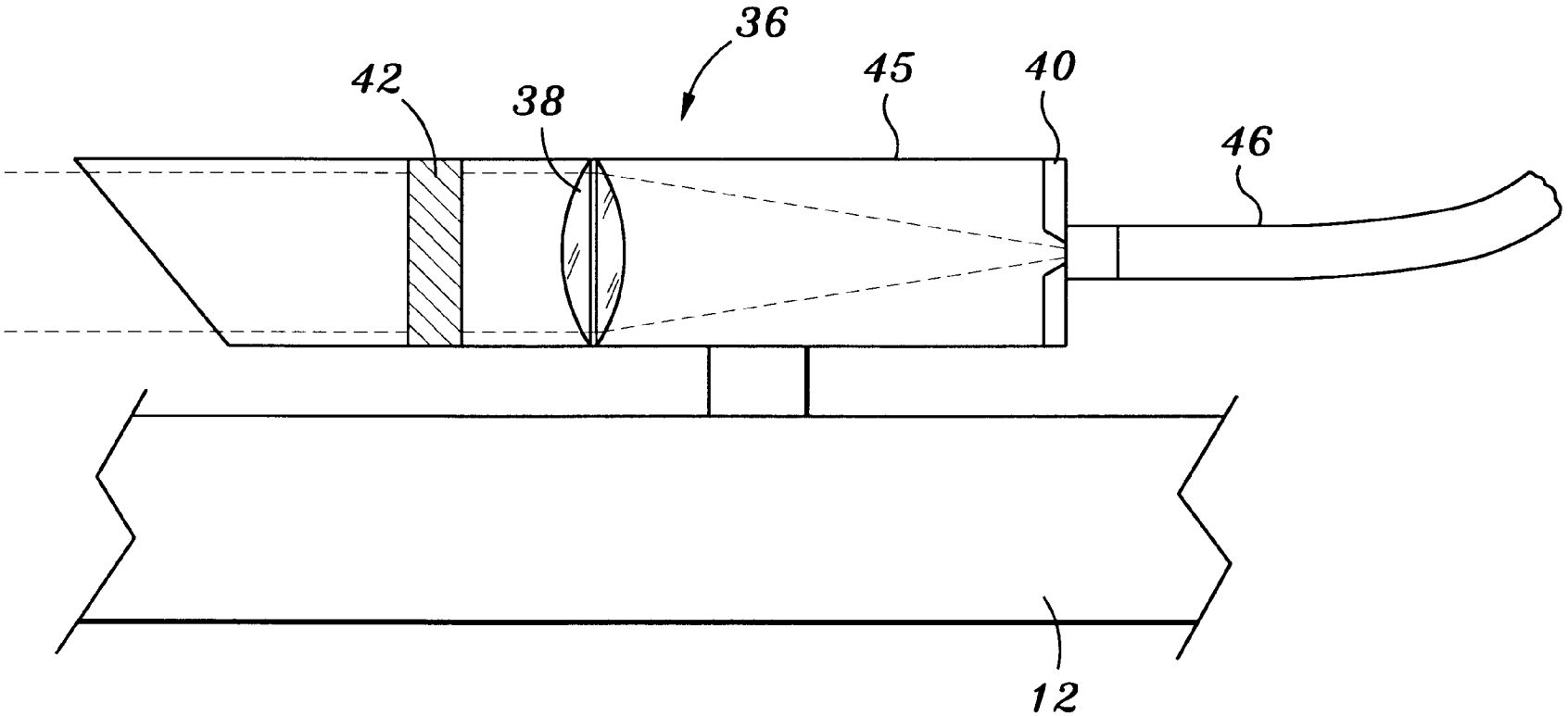
FIG. 2 is a schematic view of the target illuminator shown in FIG. 1.

A target illuminator 36 is located on the exterior surface of the elongated tube 12 of the simulated weapon 10. Preferably, the target illuminator 36 is on the top of the elongated tube 12 when the simulated weapon 10 is in the firing position. The target illuminator 36 mimics a laser targeting beam for identifying the trajectory path of a projectile or missile. The target illuminator 36 emits a high-intensity beam of light substantially in the same direction as the path of light from the high-intensity light source 44 passing through the tube 12. As shown in FIG. 2, the target illuminator 36 preferably includes a collimator 40, a focusing lens 38, and then an optical filter 42 aligned within a housing 45. The optical filter is preferably a dichroic filter. During operation, a high-intensity beam of light passes into the collimator 40 and is focussed into a beam of light via focusing lens 38 which then passes through a dichroic filter 42 to simulate a colored laser beam.

Referring to FIG. 1, the source of the high-intensity beam of light for the target illuminator 36 is the high-intensity illuminator 44. A fiberoptic cable 46 connects the high-intensity illuminator 44 to the target illuminator 36. A shutter 47 is located between the high-intensity illuminator 44 and the target illuminator 36. The shutter 47 either permits or prevents light from traveling through the fiber-optic cable 46 as required by the show.

Referring still to FIG. 1, a haze generator 50 produces theatrical haze 52 for the simulated weapon 10. The theatrical haze 52 produced by the haze generator 50 is preferably a water-based fog. The theatrical haze 52 produced by the haze generator 50 is transported to a chamber 54 for temporary storage.

A flexible tubing 56 connects between the chamber 54 and the elongated tube 12 of simulated weapon 10. Preferably, the flexible tubing 56 is a smooth bore spiral tubing. The flexible tubing 56 provides a communication path to the y-fitting 22 located on the elongated tube 12. The flow of the theatrical haze 52 through the flexible tubing 56 is metered, or controlled by a plurality of air amplifiers 60. The air amplifiers 60 are pneumatically connected to a source of compressed air, i.e., a compressor 62. The air amplifiers 60 provide a short burst of compressed air through the flexible tubing 56. This short burst of compressed air then causes the theatrical haze 52 to pulse through the elongated tube 12 and out of the open end 16. The baffle 34 creates back pressure in the tube 12, causing some of the theatrical haze or simulated smoke to spurt out of the vent holes 30. The air amplifiers 60 are preferably adjustable to alter the strength and duration of the pulse of compressed air. Consequently, variation in the compressed air pressure operating the air amplifiers 60 can provide longer or shorter muzzle flashes. A plurality of valves 64 control the flow of the compressed air to the air amplifiers 60. The valves 64 are preferably 3-way pneumatic directional valves.

A sequence control circuit 70 is provided to control the valves 64, the high-intensity illuminator 44, the shutter 48, and haze generator 50. The sequence control circuit 70 is preferably a logic controller with custom programming controls. The sequence control circuit 70 can thus be programmed to control the above-described gun characteristics to provide an accurate simulation of a muzzle flash from a fired weapon.

A mercury switch 75 is located preferably on the simulated weapon 10 as a safety switch to prevent the audience from being illuminated with the weapon 10 during a performance. The mercury switch 75 is preferably located on anything attached to the simulated weapon 10 so long as the switch closes based on erroneous or accidental orientation of the simulated weapon 10 toward the audience. The mercury switch 75 is electrically connected to the sequence control circuit 70 and shuts down operation of the simulated weapon 10 when the switch 75 is tripped.

Thus, an improved simulated weapon has been shown and described. Of course, many modifications and substitutions of equivalents can be made without departing from the inventive concepts herein. The invention, therefore, should not be restricted except in the spirit of the following claims and their equivalents.

What is claimed is:

1. A simulated weapon comprising:

an elongated tube having a closed end and an open end;

a high-intensity light source near the closed end;

a communication passageway in said elongated tube; and a haze generator connected to the communication passageway.

2. The simulated weapon according to claim 1 further including an optical filter in the elongated tube between the high-intensity light source and the open end of the elongated tube.

3. A simulated weapon comprising:

an elongated tube having a closed end and an open end;

a high-intensity light source near the closed end;

a communication passageway in said elongated tube;

a haze generator connected to the communication passageway; and a compressed air source for pulsing bursts of haze through the communication passageway.

4. A simulated weapon according to claim 3 further including a logic control circuit linked to a shutter for controlling the high-intensity source and the compressed air source.

5. A simulated weapon comprising:

an elongated tube having a closed end and an open end;

a high-intensity light source near the closed end;

a communication passageway in said elongated tube;

a haze generator connected to the communication passageway; and a target illuminator optically connected with a shutter and the high-intensity light source.

6. A simulated weapon according to claim 5 wherein the target illuminator is linked to the high-intensity light source, and further includes a focusing lens in between a collimator and a filter, with the collimator closest to the high-intensity light source.

7. A simulated weapon comprising:

a tube having a closed end and an open end;

a high-intensity light source linked to the tube;

a theatrical haze generator connected to the tube; and an air amplifier for delivering a pulse of compressed air and theatrical haze through the tube.

8. A simulated weapon according to claim 7, wherein the theatrical haze is a water-based haze.

9. A simulated weapon according to claim 7 further comprising a target illuminator optically connected with a shutter and the high-intensity light source.

10. A simulated weapon comprising:

a tube having a closed end and an open end;

a high-intensity light source linked to the tube;

a theatrical haze generator connected to the tube;

an air amplifier for delivering a pulse of compressed air and theatrical haze through the tube; and an optical filter within the tube between the high-intensity light source and the open end of the tube.

11. A simulated weapon comprising a tube having a closed end and an open end;

a high-intensity light source linked to the tube;

a theatrical haze generator connected to the tube;

an air amplifier for delivering a pulse of compressed air and theatrical haze through the tube; and a target illuminator optically connected to the high-intensity light source.

12. A simulated weapon according to claim 11, wherein the target illuminator further includes a focusing lens positioned in between a collimator and an optical filter.

13. The simulated weapon of claim 12 wherein the optical filter is a dichroic filter.

14. A simulated weapon according to claim 11 further comprising a shutter between the target illuminator and the high-intensity source.

15. A simulated weapon according to claim 14 further comprising a control circuit linked to the shutter, to the high-intensity illumination source, and to the air amplifier.

16. A method of simulating a muzzle flash in a weapon comprising the steps of:

(1) generating a quantity of theatrical haze;

(2) delivering a pressurized pulse of said theatrical haze through a barrel of the weapon; and (3) modulating a light source through the barrel of the weapon when the pressurized pulse of the theatrical haze exits the barrel of the weapon.

17. The method according to claim 16 further including modulating the light source through an optical filter as the pressurized pulse of theatrical haze exits the barrel of the weapon.

18. The method according to claim 17 wherein the optical filter is a dichroic filter.

* * * * *